United States Patent [19]

Masachika

[11] Patent Number: 4,466,357

[45] Date of Patent: Aug. 21, 1984

[54] AFTER HOUR DEPOSITORY

[75] Inventor: Hiroshi Masachika, Hiroshima, Japan

[73] Assignee: Kumahira Safe Co. Inc., Hiroshima, Japan

[21] Appl. No.: 363,388

[22] Filed: Mar. 29, 1982

[30] Foreign Application Priority Data

Feb. 3, 1982 [JP] Japan ..... 57-14832

[51] Int. Cl.[3] ..... E05G 1/26

[52] U.S. Cl. ..... 109/66; 232/44

[58] Field of Search ..... 109/66, 23 A; 232/44, 232/433

[56] References Cited

U.S. PATENT DOCUMENTS

| | | | |
|---|---|---|---|
| 1,853,486 | 4/1932 | Yeo | 232/44 |
| 2,480,685 | 8/1949 | Adams | 232/44 |
| 2,581,621 | 1/1952 | Behrens et al. | 232/44 |
| 2,617,584 | 11/1952 | Behrens | 109/66 |
| 3,704,825 | 12/1972 | Hinohara et al. | 232/44 |
| 4,063,520 | 12/1977 | Parsons | 232/44 |
| 4,176,610 | 12/1979 | Markham et al. | 232/44 |

*Primary Examiner*—Gene Mancene
*Assistant Examiner*—Kris R. Schulze
*Attorney, Agent, or Firm*—Cushman, Darby & Cushman

[57] ABSTRACT

An apparatus for depositing money in a receiving safe of a bank in which a door having a concave rear wall is rotatable between open and closed positions. A movable wall is mounted rotatably with the door to form a pocket with the concave wall when the door is open for receiving a money bag or envelope, the movable wall scraping the concave rear wall as the door rotates to its open position. A pawl is likewise mounted for rotation with the door to engage a ratchet and prevent reopening the door after it begins to close and has rotated to a position where the pocket is inaccessible.

11 Claims, 13 Drawing Figures

AFTER HOUR DEPOSITORY

BACKGROUND OF THE INVENTION

1. Field of the Invention

The present invention relates to an apparatus for depositing money into a receiving safe in bank with a high security and excellent maneuvrability in opening and closing and more particularly relates to an apparatus for depositing money into a receiving safe which can be satisfactorily operated in either of two manners, one of them being such that when a money containing bag is used a door is opened by way of key actuation and when a money containing envelope is used the door is opened without any necessity for actuating the key, while the other one being such that either a bag or an envelope is used by way of key actuation, so that the after hour depository is perfectly protected from any trick operation or attack from the outside by an unauthorized person.

2. Description of the Prior Art

A conventionally available apparatus for depositing money into a receiving safe is typically constructed such that a chute extends from an depository opening through the outside wall of the building of the bank to a safe or a money depositing chamber with a door opening and closing device arranged outward of the entrance chute whereby a money containing envelope or bag slides down through the chute by gravity as the door opening and closing device is operated. As a modified construction for an apparatus of this kind was proposed an arrangement such that an entrance opening is separately provided for a money containing bag and envelope. In view of the special working condition for this kind of money depositing safe it is an essential requirement that perfect protection is provided from any trick operation or attack from the outside by any other person. The trick operation or attack is for a third malicious person to pick up a deposited envelope or bag held on the chute with the aid of a manually operated tool, instrument or the like or allow the chute to be clogged with other foreign material or to remove contents of the sale by operating the depository apparatus. To prevent an occurence of unfair agressive or forcible operation or activity as mentioned above the conventional apparatus is equipped with various kinds of protective device or mechanism which are very complicated and thereby expense.

SUMMARY OF THE INVENTION

The present invention is intended to obviate the drawbacks with the conventional apparatus of the kind as described above. To ensure improved safety in depositing money into a receiving safe an apparatus for depositing money into a receiving safe in a bank includes a framework fitted into a rectangular opening on the front wall of the building of the bank, a door including a handle at the upper end and a half cylindrical portion at the lower end thereof the door being rotatable in the forward direction about a horizontally extending shaft located inward of the rear surface and in the vicinity of the lower end thereof, a door casing including a partition forming the concave rear wall thereof, a movable wall disposed rotatably about a second horizontally extending shaft fixedly secured to both the side walls of the door casing, the second shaft being located at the center of curvature of the partition and thereby the free end of said movable wall being adapted to come in contact with the concave surface of the partition therealong, a rotary lever adapted to rotate the movable wall in cooperation with a stationary shaft with its free end brought in contact with the concave surface of the partition therealong, and a ratchet mechanism serving to prevent the door casing from rotating in the reverse direction before the intended depositing operation has not been completed.

In order to ensure that a customer visiting the bank can use a money containing envelope without any necessity for use of a key previously given to him or he can use a money containing bag by operating the aforesaid key a locking and unlocking mechanism is provided so that rotary movement of the door casing is restricted by means of a rotary stopper which is adapted to protrude inward of the side wall or be retracted outward thereof by actuating the locking and unlocking mechanism.

Alternatively, the locking and unlocking machanism may be constructed such that the door casing is held in a completely closed location by means of a locking bolt which is adapted to enter into a recessed part on the side wall thereof. In this case a customer has to carry his key without fail regardless of whether a money containing envelope or bag is to be used.

The movable wall located behind the door casing is rotatable in the downward direction by way of gravity with its free end brought in contact with the concave surface of the partition throughout the whole travel thereof. To ensure that the movable wall resumes the original location during the rearward rotary movement of the door casing a stopper is fixedly secured to the side wall of the apparatus so as to cooperate with a stationary shaft which is adapted to abut against said stopper.

To ensure improved rigidity of the apparatus and perfect protection from agressive operation or stealing by other person, the upper surface of both the door casing and movable wall has an arched configuration as seen from the side and is corrugated as seen from the front.

Further, the upper surface of both the door casing and the movable door are guided by the inner corrugated surface of a guide member coaxially disposed outside the door casing.

The inner surface of the corrugated guide member, the concave rear surface of the partition and the upper surface of the movable wall cooperate to form a depositing pocket on which a money containing envelope or bag is placed.

To ensure that the door casing is correctly rotated the door includes a half cylindrical portion at the lower part thereof which is guided by a corresponding concave guide member coaxially disposed outside the half cylindrical portion.

Hence, it is an object of the present invention to provide an improved apparatus for depositing money in a receiving safe in a bank which has an excellent security without any danger of practicing a wrong depositing operation with a money containing envelope or bag held on the pocket or stolen by other person.

It is another object of the present invention to provide an apparatus for depositing money in a receiving safe in the bank which ensures high mechanical rigidity and smooth operation.

It is another object of the present invention to provide an apparatus for depositing money into a night working safe in a bank which may use either an envelope or the like having a relatively thin thickness or a bag or the like having a considerably larger dimension with or without the necessity for actuating a special key previously given to a customer.

Other objects and advantageous features of the present invention will be apparent from the reading of the following description made in connection with the accompanying drawings.

BRIEF DESCRIPTION OF THE ACCOMPANYING DRAWINGS

Now the present invention will be described in more details with reference to the accompanying drawings which illustrate a preferred embodiment of the invention; in which FIG. 1 is a perspective view of an apparatus for depositing money into a receiving safe in a bank in accordance with the present invention with three layers of building walls broken away therefrom for convenience of easy and clear illustration.

FIG. 5(*b*) is a partial sectional front view of the locking and unlocking mechanism in FIG. 5(*a*).

FIG. 11(*b*) is a partial sectional front view of the locking and unlocking mechanism in FIG. 11(*a*).

DETAILED DESCRIPTION OF THE PREFERRED EMBODIMENT

Figure 1:
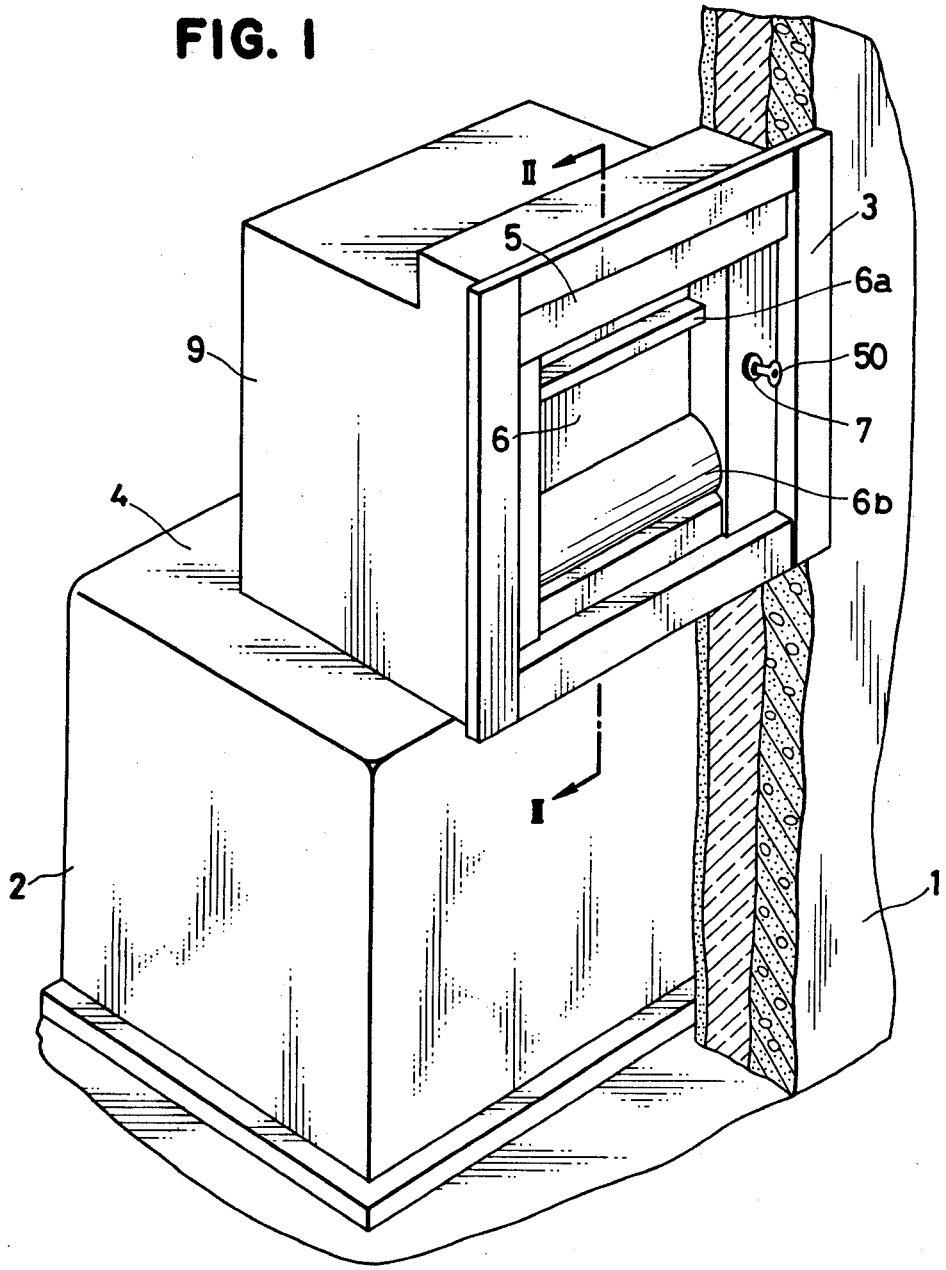

Referring to FIG. 1, a safe 2 is fixedly mounted on the ground inside the wall 1 of a bank and a rectangular framework 3 is fitted into an opening provided on the wall 1. A chute 4 extends downwards to the safe 2 and is connected thereto. Reference numeral 5 designates a illuminating lamp. A door 6 is provided with a handle 6*a* at the upper end thereof and locking and unlocking are controlled by means of a key 50 inserted into a lock 7 incorporated in the right part of the framework 3. Further, the door 6 includes a lower portion 6*b* in the form of a half cylinder the axis of rotation of which is located at a shaft 8 (FIG. 2) horizontally extending through both the side walls 9 of the framework 3, whereby the door 6 is rotatable about the shaft 8. Below the half-cylinder 6*b* is provided with a guide plate 10 which includes a trough-shaped guide 10*a* at the upper end thereof, said guide plate 10 being fixedly secured to both the side walls 9. Reference 12 designates a door casing in the form of a sector fixedly secured to the door 6. Said door casing 12 is constructed such that its corrugated projections 12*a* are engaged with the corresponding corrugated grooves of a guide member 13 of which both sides are fixedly secured to the side walls 9, whereby the door casing 12 is rotatable about the shaft 8 in the direction identified with an arrow A.

Figure 6:
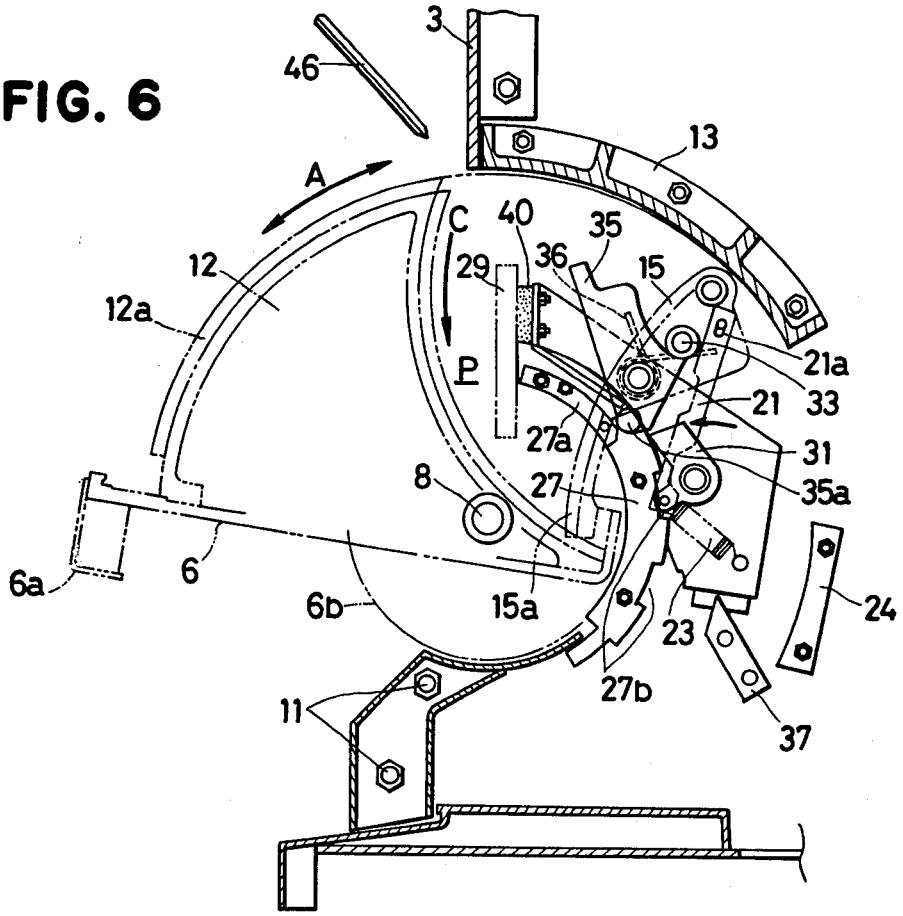
FIG. 6 is a vertical sectional side view of the apparatus in the first operational position where a money containing envelope or the like is placed in a depositing pocket, wherein the door casing and movable wall are shown in chain lines.
Figure 7:
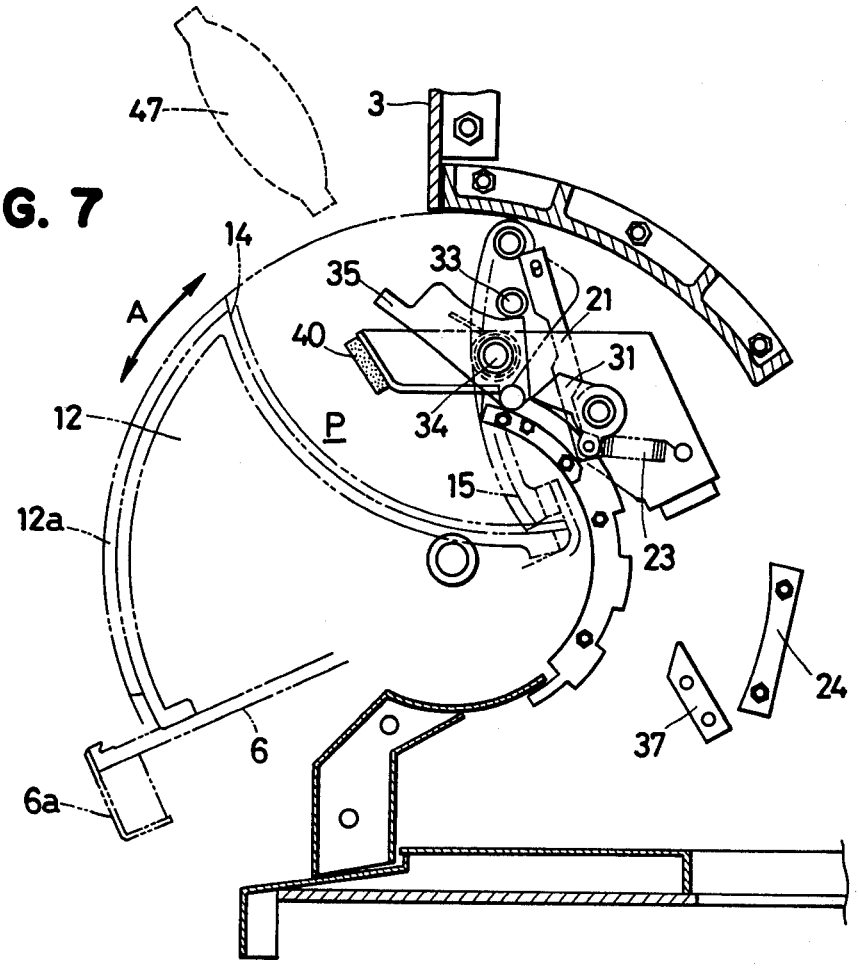
FIG. 7 is a vertical sectional side view of the apparatus in the second operational position where a money containing bag or the like is placed in the depositing pocket, wherein the door casing and movable wall are shown in chain lines.

Further, the door casing 12 includes a concave partition 14 at the inside thereof and a movable wall 15 is arranged in continuation relative to the convex portion 12*a* of the door casing 12 but it is rotatable about a shaft 16 located at the lower end thereof. The shaft 16 is located relative to the partition 14 so that a pocket P as shown in FIGS. 6 and 7 is formed as the door casing is drawn toward the front and at the same time the movable wall 15 is rotated in the anticlockwise direction with the top end thereof brought into contact with the concave wall of the partition 14. Further, the movable wall 15 includes a pin 20 at the lower end thereof from which a lever 21 extends in the horizontal direction so that a spring 23 is expanded between the pin 22 at the extreme end of said lever 21 and the lower pin 18. Said spring 23 serves to open or close a ratchet pawl, as will be described later.

Figure 3:
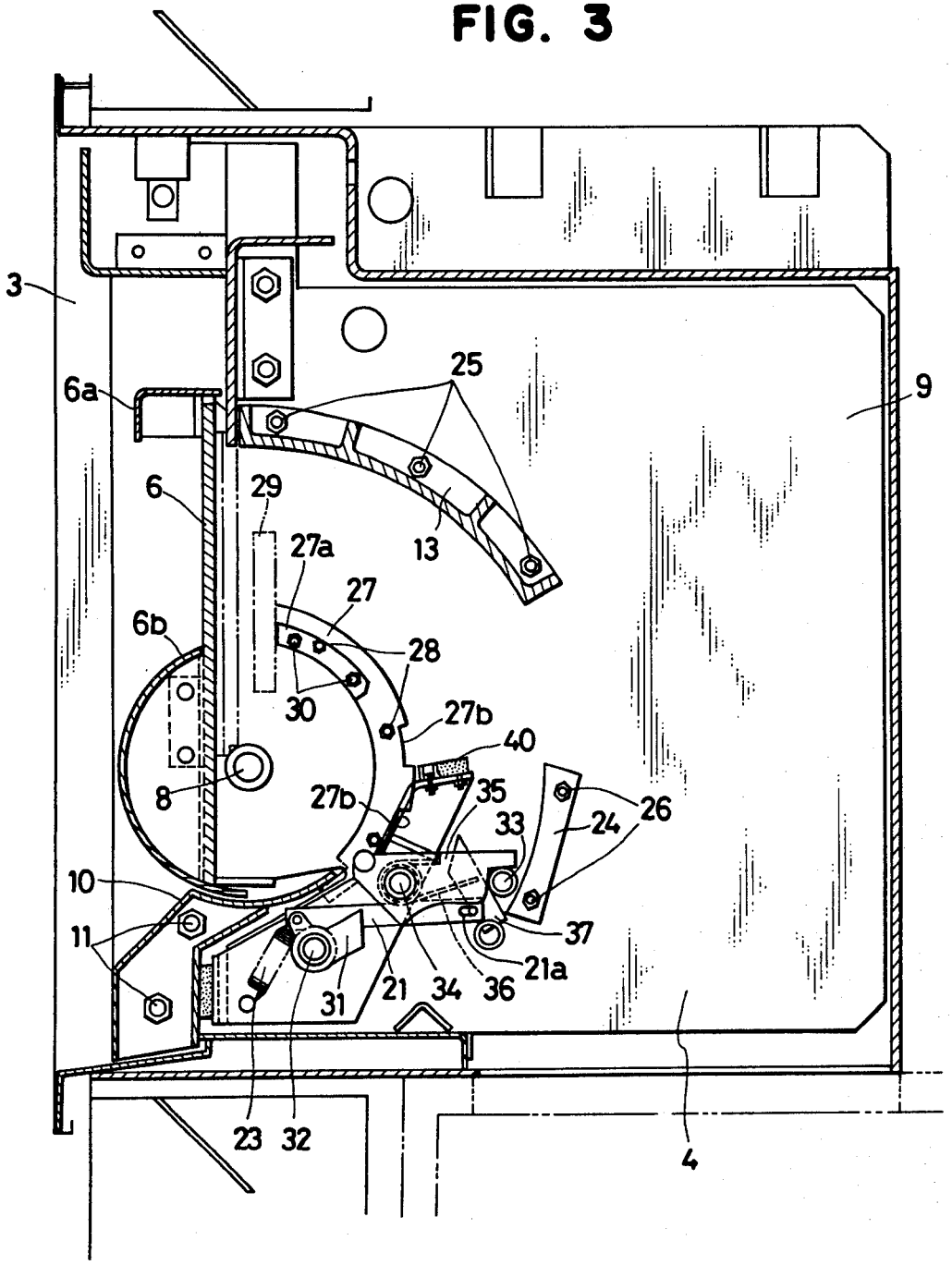
FIG. 3 is a vertical sectional side view of the apparatus particularly illustrating main actuating components for the apparatus.
Figure 4:
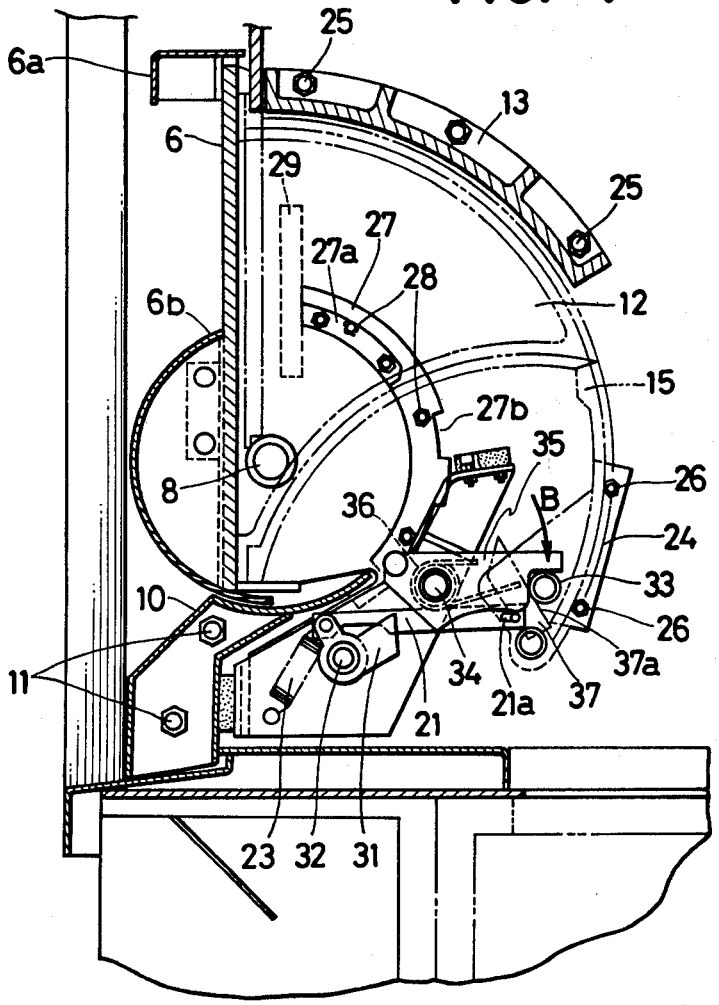
FIG. 4 is same as FIG. 3 but particularly illustrating a door casing and an associated movable wall both of which are shown in chain lines.

FIG. 3 is a side view illustrating how the parts and components secured to the side walls 9 and the movable wall 15 are located and operated, wherein the door casing 12 and the movable wall 15 are omitted in the drawing for the purpose of simplification of illustration. FIG. 4 is intended to illustrate the positional relation between the door housing 12 and the movable wall 15.

Referring to FIG. 3 and 4, the corrugated guide member 13 and the lower guide member 24 are fixedly secured to the side walls 9 by means of bolts 25 and 26. Alternatively, they may be fixed thereto by way of welding. A ratchet plate 27 is fixedly secured to the side walls by means of bolts 28 in the same manner as the foregoing. Said plate 27 includes a stopper 27*a* fixedly secured thereto by means of bolts 30. Further, the ratchet plate 27 is formed with upper and lower ratchet grooves 27*b* in spaced relation. Further, a rotary stopper 29 is provided which is adapted to project inwards from the side wall 9 so that the door is drawn to the first open position where paper money contained in an envelope can be deposited without any necessity for operating a key.

Behind the door housing 12 are arranged a stopper 40 and ratchet pawl 31, the latter being rotatable about a shaft 32 in such a manner that its rotary movement is restrained by means of the aforesaid spring 23.

Further, the door casing 12 is provided with a stationary shaft 33 secured to the movable wall 15 to be in operative association therewith and another stationary shaft 34 secured to the door casing 12 to be in operative association therewith and a rotary lever 35 is disposed between both the stationary shafts 33 and 34, wherein the rotation center of said rotary lever 35 is located at the stationary shaft 34 and the free end of the rotary lever 35 is brought in contact with the stationary shaft 33. Reference numeral 36 designates a resilient member provided about the stationary shaft 34 in order to urge the rotary lever 35 to rotate in the direction identified with an arrow B. Since the stationary shafts 33 and 34 are fixedly secured to the side walls of the door casing, they are displaced upwards at the same time as the door 6 is drawn toward the front. Reference numeral 37 designates a stopper fixed to the side walls 9, said stopper 37 being located such that the stationary shaft 33 comes in abutment therewith when the door is pushed back in the inward direction.

Figure 5B:
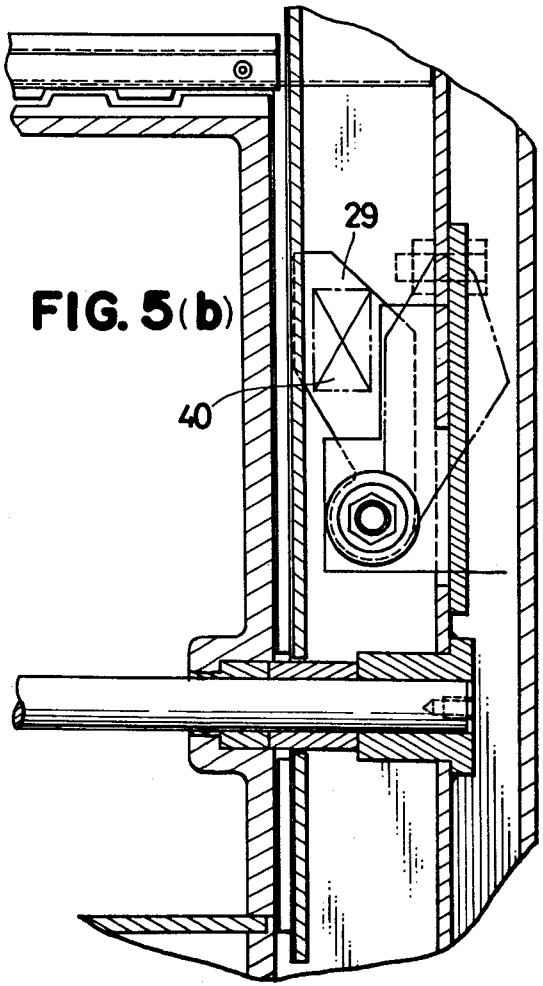
FIG. 5(*a*) is a partial sectional side view of a locking and unlocking mechanism for the apparatus, shown in an enlarged scale.
Figure 5A:
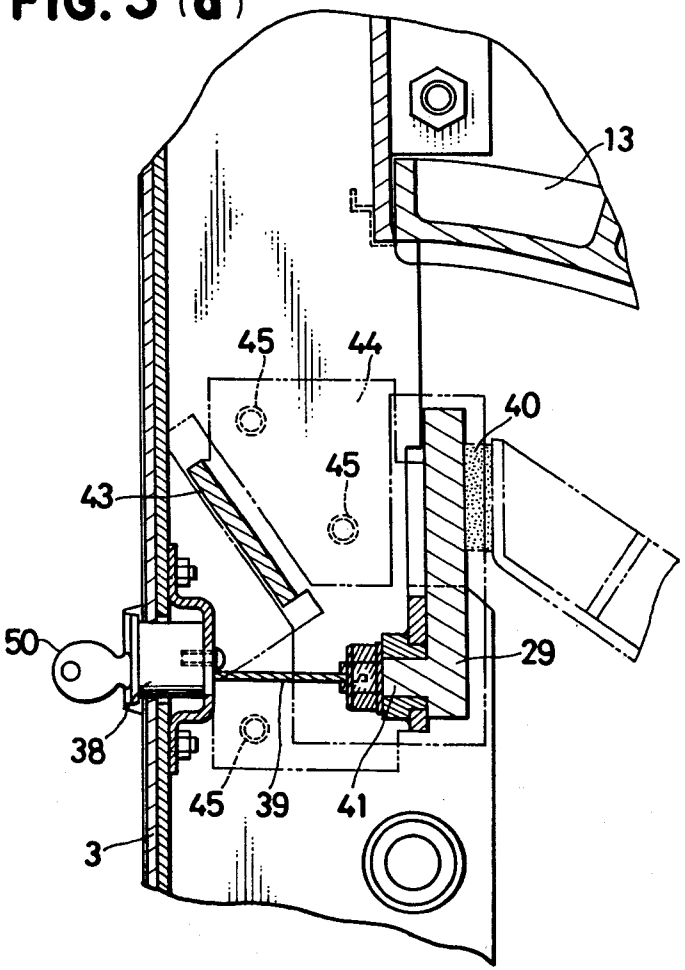

Next, FIG. 5(*a*) is partial sectional side view of an example of a locking and unlocking mechanism for the apparatus, whereas FIG. 5(*b*) is a sectional front view of the mechanism in FIG. 5(*a*). The locking and unlocking mechanism as mentioned above comprises a cylinder head 38 firmly fitted through the framework 3, a connecting rod 39 adapted to be rotated by means of a key 50, a rotary stopper shaft 41 into which said connecting rod 39 is fixedly received, a rotary stopper 29 integrally secured to said rotary stopper shaft 41, said stopper 29 being adapted to project inwards from the side walls 9 by way of rotation of the connecting sahft 39, and another stopper 43 which allows the door to be opened to the second position where a bag or the like containing paper money therein is deposited. A support plate 44 for the stopper 43 is integrally secured to the side wall 9. Alternatively it may be attached thereto either by way of welding or by means of a plurality of bolts 45. When the rotary stopper 29 is actuated to protrude toward the door casing 12, it is locked at the first position where the stopper 40 comprising a shock absorbing material comes in abutment against the rotary stopper 29, whereas when the key is actuated for the purpose of unlocking, the rotary stopper 29 is retracted outward to the side wall 9.

Now operation of the apparatus constructed in the above-described manner will be described below.

Figure 2:
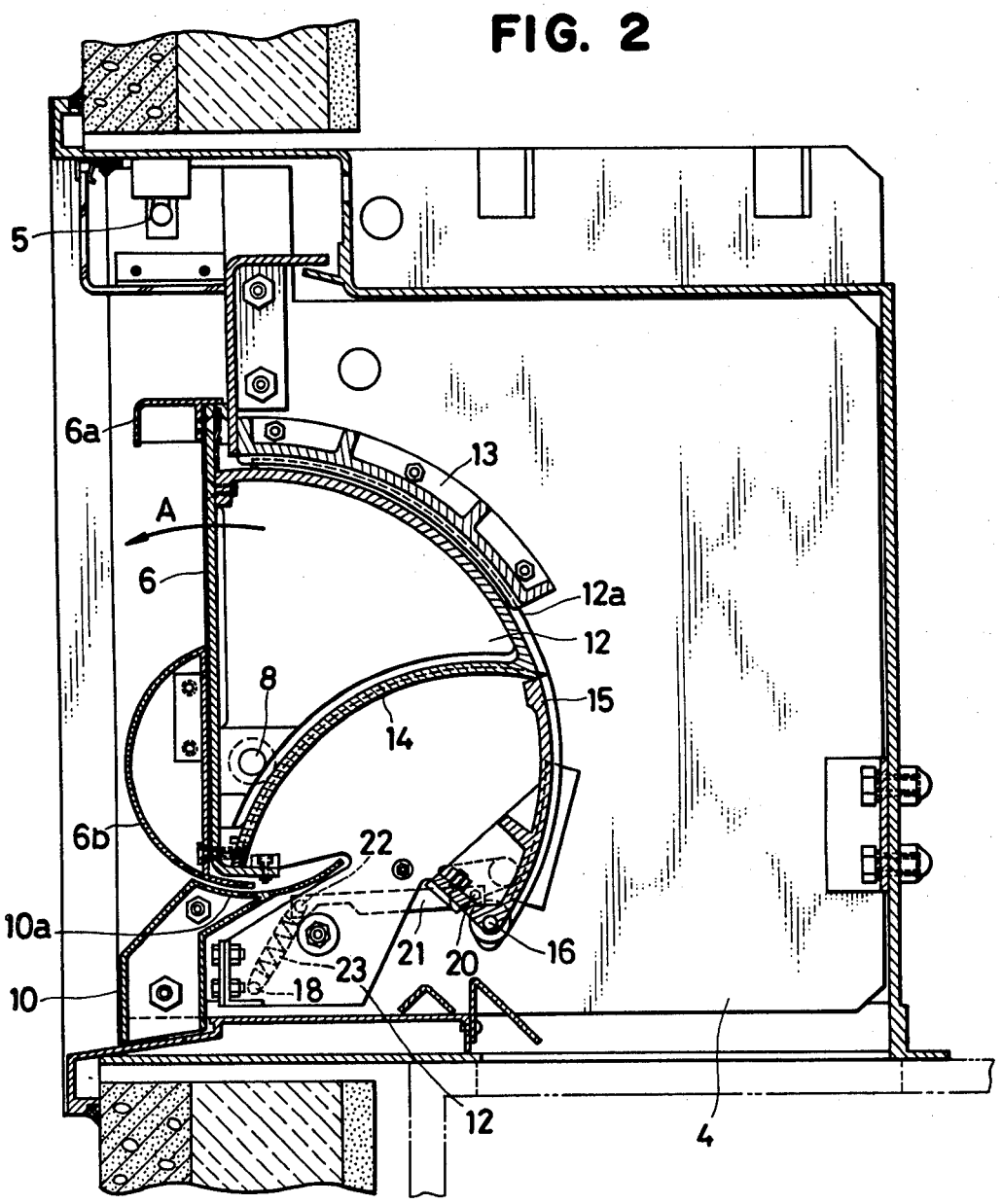
FIG. 2 is a vertical sectional side view of the apparatus taken in line II—II in FIG. 1.

First, description will be made with respect to the case where paper money or the like contained in an envelope is deposited in the receiving safe. When the handle 6*a* at the upper end of the door 6 is drawn to the front with the lock 38 kept in the locked position, the door 6 and the door casing 12 are rotated to the first position as shown in FIG. 6 so that the stopper 40 comes in abutment against the rotary stopper 29. As a result the stopper 40 comes to a stop, but just before the stoppage takes place, the end part 35*a* of the rotary lever 35 comes in abutment aginst the projection 27*a* of the ratchet plate 27, whereby the rotary lever 35 is rotated against the resilient force of the resilient member 36, causing the stationary shaft 33 to be displaced from the circular track of the rotary lever 35. Thus, the movable wall 15 is rotated by gravity in the direction as identified with an arrow C with the forward end 15*a* thereof coming in contact with the concave surface of the partition 14 of the wall casing 12. As a result the pocket P is fully protruded when the forward end 15*a* of the movable wall is lowered to the extreme lower end (see FIG. 6). When placing the envelope 46 in the pocket P and thereafter manually pushing back the door to resume its original position, the envelope 46 is thrown down in the inward direction by the restoring force of the movable wall until the original location of the movable wall as shown in FIG. 2 is reached. The steps of operations as mentioned above will be described in a greater detail below with respect to the case where a money containing bag is deposited.

When a customer comes to the depository to deposit money using a bag or the like, he operates the key 50 specially assigned to him so as to rotate the connecting rod 39 with the aid of the locking and unlocking mechanism as shown in FIG. 5 until the rotary stopper 29 is retracted outward to the side wall. Then the door 6 is fully opened to the position as shown in FIG. 7 by drawing the door at the handle 6*a* to the foremost end. As a result the widest pocket P is provided and then he places his bag on it. As is apparent from FIG. 7, the door 6 and the door casing 12 come to a stop when the stopper 40 abuts against the stopper plate 43 transversely extending from the left end of support plate 44 as shown in FIG. 5.

After the money containing bag or the like is placed on the fully opened pocket P, it is deposited into the safe 2 by way of the following steps.

Figure 8:
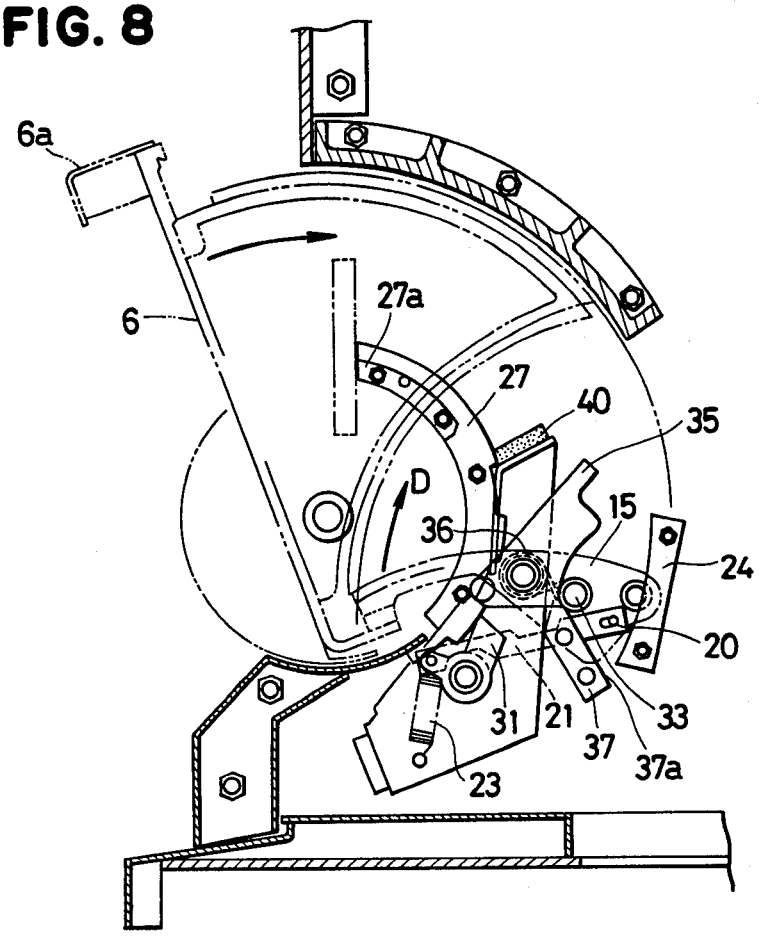
FIG. 8 is a vertical sectional side view of the apparatus illustrating that the door casing and movable wall are moving toward the fully closed position.

Specifically, when pushing the door 6 at the handle 6*a* in the inward direction to reach the position as shown in FIG. 8, the stationary shaft 33 comes in abutment against the lower stopper 37. Since the stationary shaft 33 is fixedly secured to the movable wall 15 and thereby is in operative association with the latter, it slides down along the upper inclined face 37*a* of the stopper 37 as the door casing 12 is rotated further, whereby the movable wall 15 is rotated in the opposite direction to the case when the door is opened, i.e., in the direction identified with an arrow D. When the stationary shaft 33 comes down to a certain lower position, the rotary lever 35 resumes its original horizontally extending posture. By rotating the movable wall 15 in the direction D the envelope 46 or the bag 47 placed in the pocket P is thrown down therefrom into the safe by way of the chute 4.

Summarily speaking, the apparatus in accordance with the present invention is operated by way of the steps of drawing the door casing 12 with the aid of the handle 6*a* of the door 6, rotating the movable wall 15 in the anticlockwise direction as seen in the drawings with the foremost end thereof brought in contact with the concave wall of the partition 14, forming a pocket P between the partition 14 and the movable wall 15, placing a money containing envelope or bag on the pocket, then pushing back the door 6 with the envelope or bag held on the movable wall 15 and finally throwing down it therefrom into the safe by rotating the movable wall 15 in the reverse direction. Thus, the apparatus has no danger that the door 6 is closed with the money containing envelope or bag held on the movable wall 15 or the pocket P.

As the movable wall 15 is rotated by gravity in the direction C in FIG. 6 with the stationary shaft 33 disengaged from the circular track of the rotary lever 35 during the operations as mentioned above, the ratchet pawl 31 is rotated in the anticlockwise direction as seen in FIG. 6 by the loosening of the lever 21 extending from the pin 20 of the movable wall 15 and the tensile force of the spring 23, whereby the forward end of the ratchet pawl 31 comes in engagement with the ratchet groove 27*b* of the ratchet plate 27. As is apparent from FIG. 6, the door 6 is fully opened with the ratchet pawl 31 not engaged into the ratchet groove 27*b*. However, the arrangement is made such that the ratchet pawl 31 comes in engagement into the ratchet grooves 27*b* when the bag or the like is placed on the pocket and thereafter the door 6 is pushed back just behind the location where the corrugated arched surface 12*a* on the door casing 12 overlapps the corrugated portion of the corrugated guide member 13 and then the door 6 is intended to be opened again. Thus, the ratchet pawl 31 serves as a reverse movement prevention means for the door 6 until the door 6 resumes the original position and thereby the envelope or bag is thrown down via the chute 4. Since the pin 20 is designed such that it moves within the elongated opening 21*a* on the lever 21, the door can be closed wihtout any displacement of the movable wall 15 irrespective of the movement of the lever 21 caused by the rotation of the ratchet pawl 31 during the door closing operation.

Next, opening of the ratchet pawl 31 is effected by way of the following steps.

Figure 9:
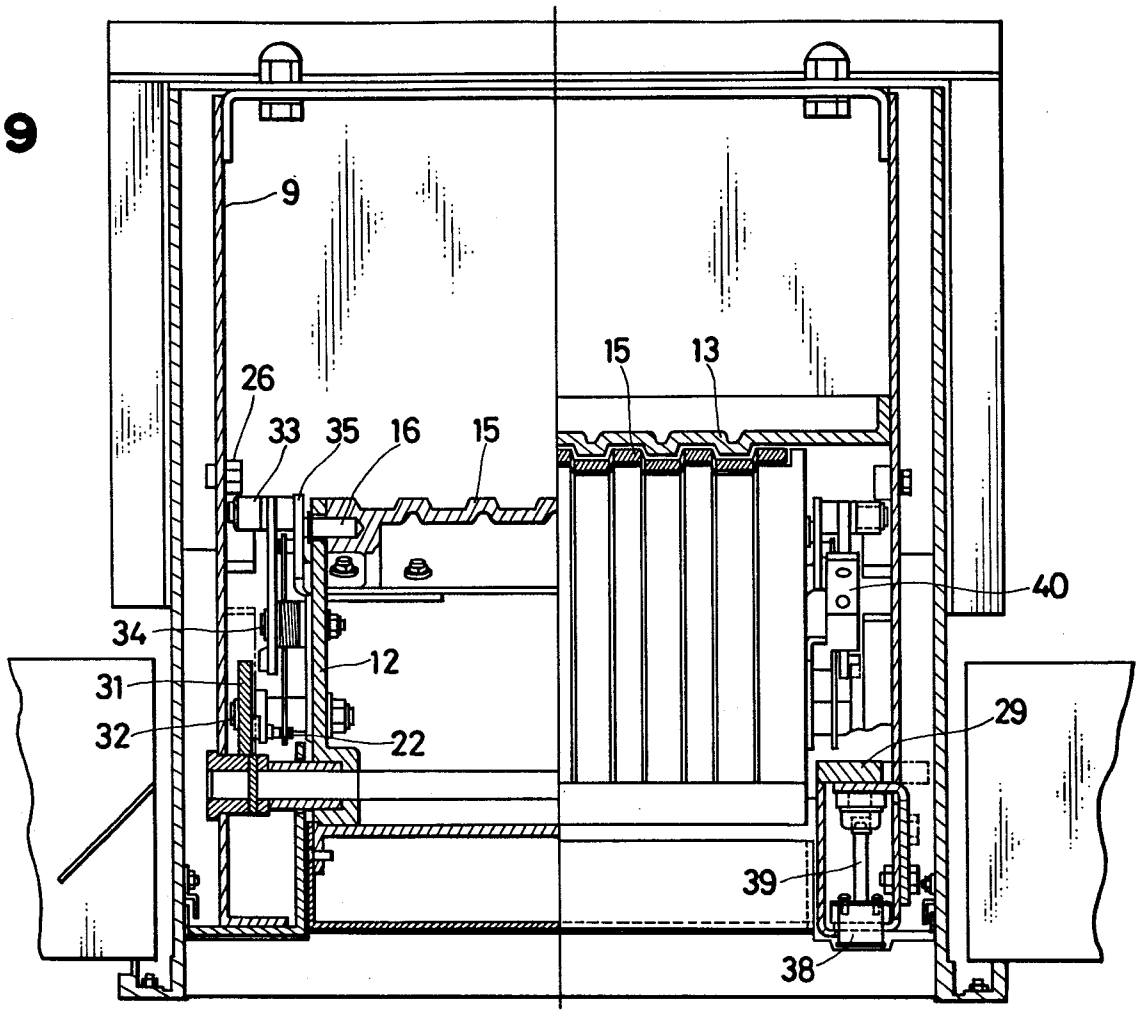
FIG. 9 is a transverselly sectioned view of the apparatus in the fully closed location, wherein the left half part of the drawing illustrates the operative connection of the door casing to the actuating components and the right half part of the same the operative connection of the door casing to the locking and unlocking mechanism.

Before the door 6 and the door casing 12 resume their original position, first the stationary shaft 33 comes in abutment against the stopper 37. Next, any displacement of the movable wall 15 toward the chute 4 is effectively prevented by means of a guide member 24 (see FIG. 2) during the sliding movement of the stationary shaft 33 along the upper inclined face 37*a* of the stopper 37, wherein the movable wall 15 has a center of rotation at the shaft 16 which is located at the center of curvature of the partition 14 of the door casing 12. Since the rotary lever 35 resumes the original position by means of the resilient means 36 and thereby the stationary shaft 33 becomes located along the circular face of the rotary lever 35, the result is that the movable wall 15 becomes coaxial relative to the arched surface 12*a* of the door casing 12. As a result the ratchet pawl 31 is disconnected from the ratchet groove 27*b* in a spaced relation by means of the lever 21 whereby operation is ready for the next deposit. FIG. 9 is a half sectional view illustrating the closed door 6, wherein the left part of FIG. 9 is a detailed sectional view of the main part of the apparatus.

Figure 10:
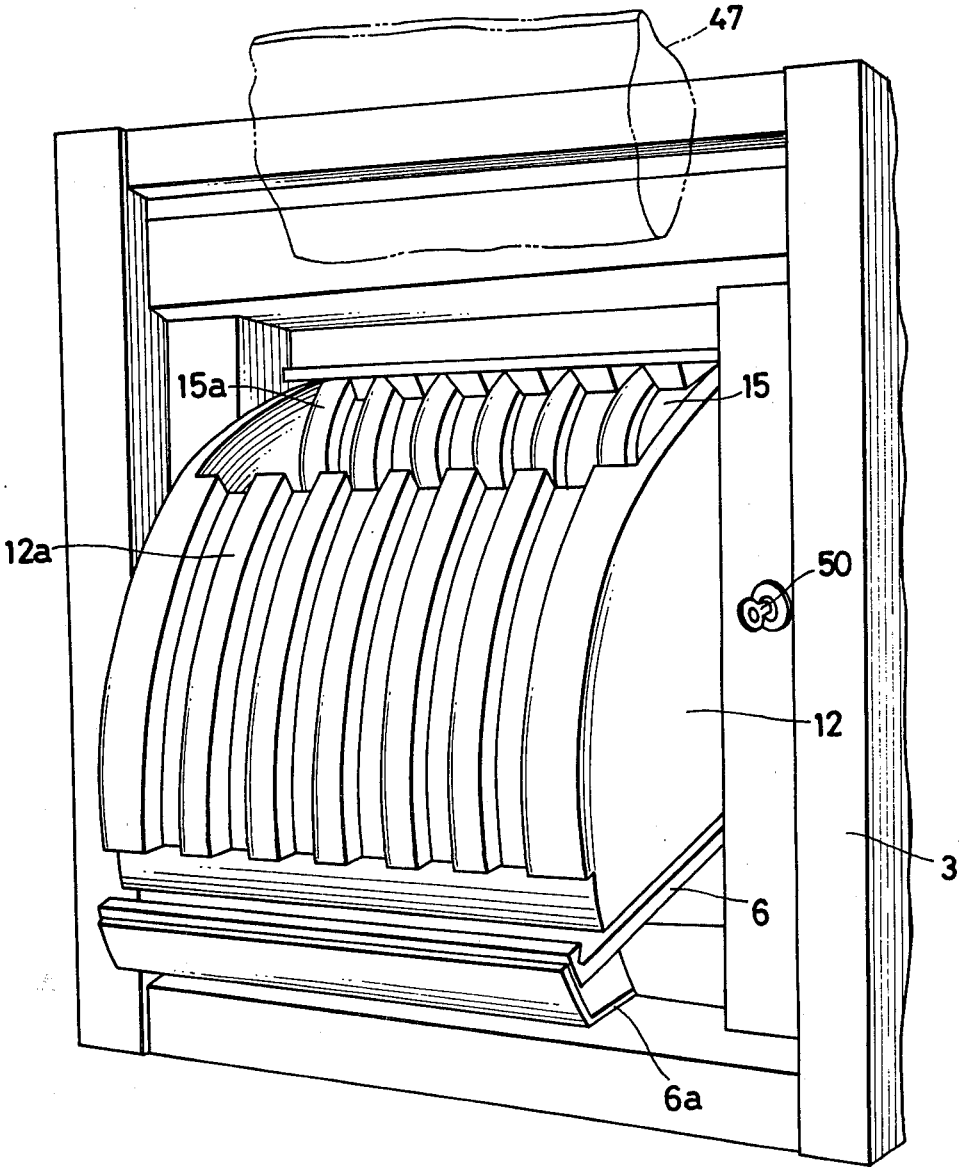
FIG. 10 is a partial perspective view of the apparatus with the door drawn forward to the fully opened position.

FIG. 10 is a partial perspective view illustrating that the door 6 is drawn to the open position. It will be readily apparent from the drawing that the door casing 12 has a corrugated surface 12*a* in the form of an arch as seen in the cross-sectional plane and the movable wall 15 has also a corrugated surface 15*a* in the form of an arch as seen in the cross-sctional plane so that both the corrugated surfaces 12*a* and 15*a* come in engagement with one another. Thus one to the arrangement as described above it is ensured that damage or injury given to the door 6, door casing 12, framework 3 and others by means of a cutting tool or the like is substantially prevented and moreover mechanical strength of the apparatus is remarkably improved.

Figure 11:
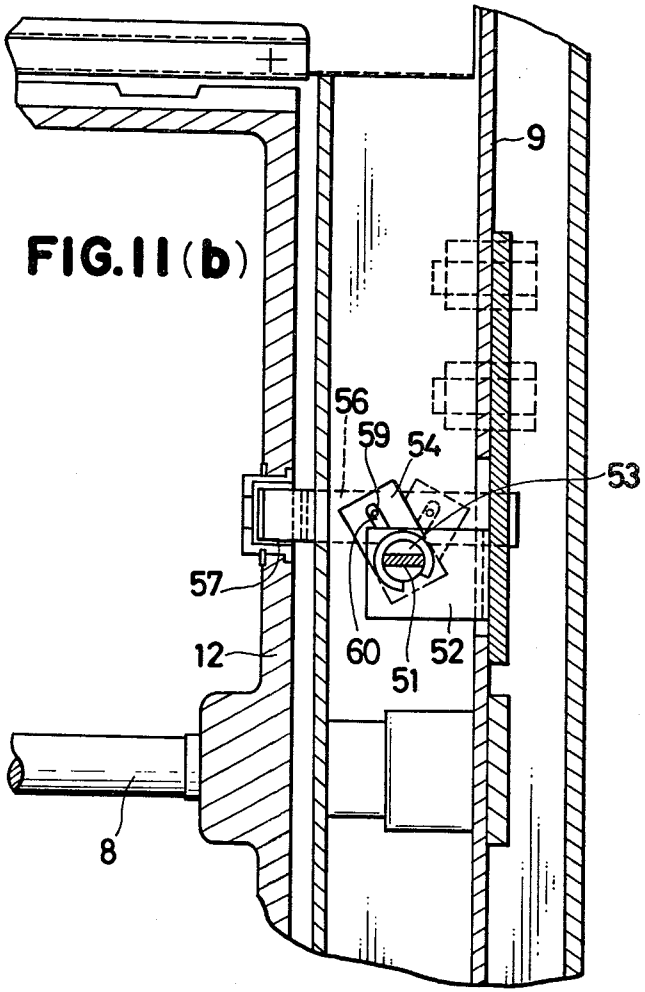
FIG. 11(*a*) is a partial sectional side view of a locking and unlocking mechanism in accordance with a modified embodiment of the invention.
Figure 11:
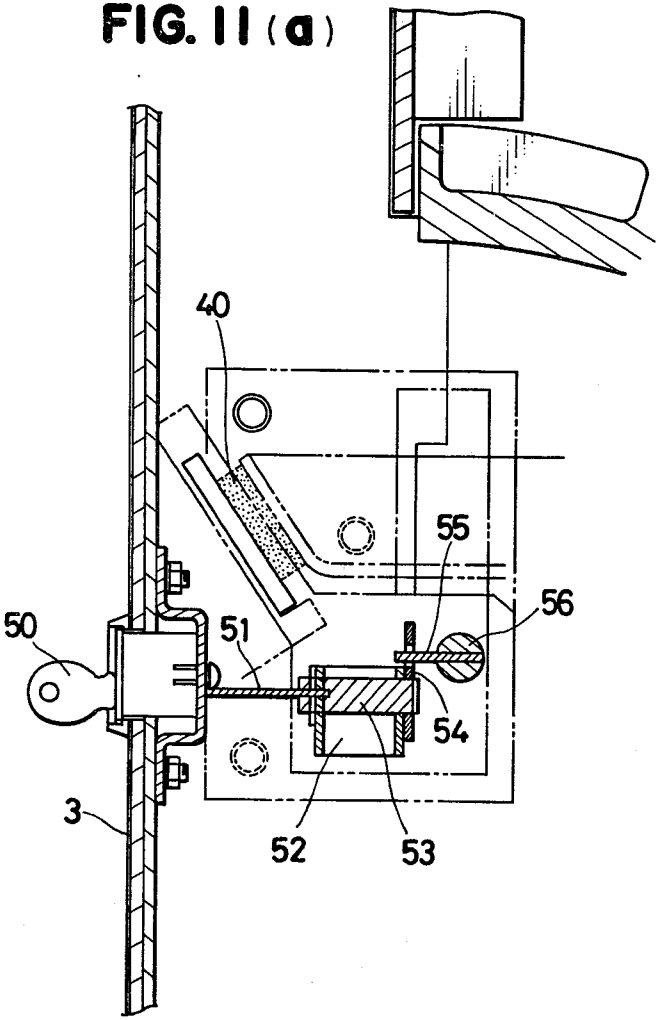

Next, FIG. 11(*a*) is a partial side view of a locking and unlocking mechanism in a modified embodiment of the present invention and FIG. 11(*b*) is a partial front view of the locking and unlocking mechanism in FIG. 11(*a*). This locking and unlocking mechanism is intended to ensure that the door 6 for the after hour depository is perfectly locked. In this modified embodiment it is necessary to effect unlocking with the use of the key 50, even when depositing a money containing means having a thin thickness such as an envelope or the like. The locking and unlocking mechanism in accordance with the embodiment is characterized in that during the opening operation of the door the key 50 can not be disconnected therefrom by allowing a locking bolt 56 to be engaged with the side wall of the door casing 12 whereby there is no danger of forgetting the locking of the door 6 so that an improved safety is ensured. Specifically, an arrangement is made such that the connecting rod 51 adapted to be rotated by means of the key 50 inserted from the front side of the framework 3 is connected to a lever shaft 53 rotatably carried by a bearing 52 to rotate said lever shaft 53 and thereby swing a swing plate 54 fixedly secured to the former by way of welding or the like. Further, the locking bolt 56 comes in engagement to a socket 57 on the side wall of the door casing 12 by means of a pin 59 fitted into an elongated opening 60 on the lever plate 54. Since the pin 59 is displaceable along the elongated opening 60 as the lever plate 54 swings about the lever shaft 53, the locking bolt 56 moves linearly to and from the socket 57 by the rotation of the connection rod 51. Thus, the opening of the door casing 12 can be controlled by means of the key 50. Normally, the door 6 is locked by means of the locking bolt 56 so that it is fully closed. It can be opened only when a customer effects unlocking by actuating the key 50 which is specially assigned to him. As a result perfect locking is ensured for preventing any stealing from the outside.

The apparatus for depositing money into a receiving safe in a bank in accordance with the present invention has been described above with respect to a preferred embodiment of the same. Now the advantageous features of the apparatus will be briefly summarized below.

1. Only a customer who holds a key 50 previously prepared by a bank can operate the apparatus. Thus, any other person can not operate it.

2. He can deposit money using either an envelope or a bag. When using an envelope, he draws the door to the first position where it is half opened without any necessity for the key, whereas when using a bag, he draws it to the widest opening by actuating the key.

3. Once the door is drawn forwards and thereby is opened to the predetermined position, it can not be drawn for the purpose of allowing it to be opened further, unless it resumes the fully closed position. Thus, there is no danger of an envelope or a bag failing to be thrown down as it is held on the pocket or movable wall and picked up by another person at a later time.

Even if some adhesive material is applied on the movable wall and a deposited item is stuck on it, the next operation opening the door will scrape it and force it to drop into the chute.

4. Insertion of fishing wire or like through the pocket into the receiving safe or chute is extremely difficult because of the corrugated engagement of door casing and guide member as well as the close relation of half cylinder (6*b*) and trough-shaped guide plate (10). Also any fished item may be scraped by the guide member when the door is opened for the purpose of removing the fished item and will drop into the chute.

5. Smooth door operation is effected without any particular difficulty.

6. Substantially improved safety and rigidity are ensured without any danger of stealing by another person.

What is claimed is:

1. An apparatus for depositing money into a receiving safe in a bank comprising:

a framework adapted to be fitted into a rectangular opening on a bank wall;

a door having a front surface closing said opening, a handle at the upper end thereof, side walls and a rear partition defining a concave rear wall;

a first horizontally extending shaft in said framework mounting said door for rotation thereabout;

a movable wall;

a second shaft extending between said side walls for rotation with said door and mounting said movable wall for rotation so that rotation of said door from a closed to an open position causes said movable wall to rotate in a first direction, scraping said concave rear wall, to a position defining a pocket for receiving a package for deposit and rotation of said door from said open to said closed position rotates said movable wall in a second direction opposite to said first direction to release a package in said pocket;

a first rotary lever engaging said movable wall for rotating said wall, said first lever releasing said movable wall so that said movable wall rotates by gravity while scraping said rear wall;

a rachet mechanism including a pawl, a shaft third extending between said side walls mounting said pawl for rotation with said door and a rachet plate fixedly-secured to a side wall of the framework, the rachet plate including a plurality of grooves, said rachet pawl being pivotally disposed by said third shaft, the rachet pawl being adapted to engage a said groove in said rachet plate, and;

a second rotary lever having first and second ends engaging said pawl at the first end and pivotally attached to said first rotary lever at the second end during rotation thereof and releasing said pawl from said groove when said door is in said open position so that, upon rotation of said door thereafter toward said closed position at a position wherein said pocket is inaccessible, causes said pawl to engage said groove and prevent rotation of said door in said first direction until said door is in said closed position.

2. An apparatus for depositing money into a receiving safe in a bank as defined in claim 1 further including a locking and unlocking mechanism which comprises a lock incorporated in the framework and a key inserted into said lock, and a rotary stopper which normally projects inward of the side walls to limit rotational movement of said door in said first direction and is retracted outward thereof by the actuation of the locking and unlocking mechanism.

3. An apparatus for depositing money into a receiving safe in a bank as defined in claim 1 further including a locking and unlocking mechanism which comprises a lock incorporated in the framework, a key inserted into said lock and a locking bolt engagable into a socket on one of said side walls for holding said door in said closed position.

4. An apparatus for depositing money into a receiving safe in a bank as defined in claim 3, wherein said ratchet plate includes a stopping member fixedly secured thereto which serves to allow the first rotary lever to be rotated during the rotatable movement of the door in said first direction so that the movable wall is rotated with its free end brought in contact with the concave surface of the partition.

5. An apparatus for depositing money into a receiving safe in a bank as defined in claim 4, wherein the movable wall is rotatable in the downward direction by way of its dead weight with its free end brought in contact with the concave surface of the partition.

6. An apparatus for depositing money into a receiving safe in a bank as defined in claim 1, wherein a stopper is fixedly secured to a side wall of the framework, said stopper allowing the movable wall to resume the original position during the rotatable movement of the door in said second direction by abutment of the second shaft against the stopper.

7. An apparatus for depositing money into a receiving safe in a bank as defined in in claim 1, wherein the upper surface of both the door and movable wall has an arched configuration as seen from the side and is corrugated as seen from the front.

8. An apparatus for depositing money into a receiving safe in a bank as defined in claim 7, wherein the upper-surface of the door is guided by the inner corrugated surface of a guide member coaxially disposed outside the door casing and said pawl cannot engage said groove until the corrugated surfaces of the guide member and door overlap.

9. An apparatus for depositing money into a receiving safe in a bank as defined in claim 8, wherein the inner surface of the corrugated guide member, the concave surface of the partition and the upper surface of the movable wall cooperate to provide a depositing pocket on which a money containing envelope or bag is placed.

10. An apparatus for depositing money into a receiving safe in a bank as defined in claim 1, wherein the door has a lower half cylindrical portion located at the lower part of the door and guided by means of a corresponding concave guide coaxially disposed outside the half cylindrical portion.

11. An apparatus for depositing money into a receiving safe in a bank as defined in claim 1 wherein an illuminating lamp is provided above the door.

* * * * *